US005699439A

United States Patent [19]

Geisenberger et al.

[11] Patent Number: 5,699,439

[45] Date of Patent: Dec. 16, 1997

[54] LOUDSPEAKERS

[75] Inventors: Stefan Geisenberger, Straubing; Manfred Aigner, Schwarzach, both of Germany

[73] Assignee: Nokia Technology GmbH, Pforzheim, Germany

[21] Appl. No.: 447,888

[22] Filed: May 23, 1995

[30] Foreign Application Priority Data

Jun. 1, 1994 [DE] Germany ..... 44 19 253.3
Jun. 28, 1994 [DE] Germany ..... 44 22 486.9

[51] Int. Cl.[6] ..... H04R 25/00

[52] U.S. Cl. ..... 381/194; 381/199; 381/202

[58] Field of Search ..... 381/199, 194, 381/202, 193, 185, 192

[56] References Cited

U.S. PATENT DOCUMENTS

| | | | |
|---|---|---|---|
| 3,925,626 | 12/1975 | Stallings, Jr. | 381/194 |
| 4,029,911 | 6/1977 | Albinger | 381/193 |
| 4,567,327 | 1/1986 | Goossens et al. | 381/193 |
| 4,590,333 | 5/1986 | Strohbeen | 381/195 |
| 5,062,140 | 10/1991 | Inanaga et al. | 381/201 |
| 5,283,397 | 2/1994 | Pavlovic | 181/163 |

FOREIGN PATENT DOCUMENTS

| | | | |
|---|---|---|---|
| 0251057 | 1/1988 | European Pat. Off. . | |
| 0297572 | 1/1989 | European Pat. Off. . | |
| 0209293 | 12/1983 | Japan | 381/193 |
| 522555 | 7/1976 | U.S.S.R. . | |
| 9209180 | 5/1992 | WIPO . | |

OTHER PUBLICATIONS

*Patent Abstracts of Japan*, vol. 11, No. 61 (E-483), Feb. 25, 1987 & JP-A-61 220592, Kozo Sakane, Sep. 30, 1986, one page.

"High Performance Loudspeakers", M. Colloms, 3rd Ed., Pentech Press, London, Plymouth, 1985, pp. 118–119 and 128–129.

"Die Verfahren der Schweisstechnik", Deutscher Verband fur Schweisstechnik e.V., Dusseldort, 1974.

*Primary Examiner*—Curtis Kuntz
*Assistant Examiner*—Xu Mei
*Attorney, Agent, or Firm*—Ware, Fressola, Van Der Sluys & Adolphson LLP

[57] ABSTRACT

According to the state of the art, insofar as the respective components of the loudspeaker cannot be built in one piece, the respective components of the loudspeaker are joined to each other by adhesives. For example, it is known to bond the aluminum voice coil support (10) to the paper loudspeaker diaphragm (11). However, if loudspeakers with such bonded joints must operate above 120 degrees Celsius, no long-term continuous operation of the mechanically highly stressed adhesion can be expected. The invention therefore has the task of presenting a very strong mechanical joint of the loudspeaker components. The task is fulfilled according to the invention, in that at least the surface areas (13.1, 13.2) of the loudspeaker components to be joined to each other [perhaps the voice coil support (10) and the loudspeaker diaphragm (11)] are made of metals that can be ultrasonically welded to each other, and that the joint between the two components of the loudspeaker is ultrasonically weldable. Insofar as required, an insulation arrangement (16) can be placed between the two just mentioned loudspeaker components, which can be ultrasonically welded to the respective components of the loudspeaker [in this instance loudspeaker diaphragm (11) and voice coil support (10)], through their metal coatings (19.1, 19.2), which are also made of ultrasonically weldable metal.

19 Claims, 4 Drawing Sheets

LOUDSPEAKERS

TECHNICAL FIELD

The invention concerns the production of high-temperature-resistant connections of loudspeaker components, particularly the connection of loudspeaker diaphragms to voice coil supports.

BACKGROUND OF THE INVENTION

According to the state of the art, loudspeaker diaphragms and loudspeaker voice coil supports are joined by adhesive bonding, insofar as they are not constructed as one piece. For example, it is known to join an aluminum voice coil support to a plastic, metal or paper loudspeaker diaphragm by means of an adhesive. The requirements placed on such bonds are also known. Such a joint should be light, both materials should be firmly attached to each other, even under thermal influence, and should also be simple and quick to construct.

Loudspeakers with an aluminum voice coil support and a plastic, metal or paper loudspeaker diaphragm satisfy these requirements up to operating temperatures of 120 degrees Celsius. The temperature-resistance of the bond is quickly reduced if the loudspeakers are subjected to higher ambient temperatures. Although measures such as using improved adhesives produce slightly higher temperature-resistance, they require adhesives whose use can no longer be justified under the present environmental points of view.

These problems also occur when the voice coil support or the loudspeaker diaphragm are joined by bonding to a so-called centering diaphragm.

One-piece construction of voice coil support and plastic loudspeaker diaphragm can only partially solve these problems, since these materials do not possess the necessary resistance in the desired temperature range either.

One-piece metal construction of voice coil support and loudspeaker diaphragm with the desired characteristics cannot presently be produced in a cost-effective manner. It is particularly not possible to manufacture an aluminum or titanium loudspeaker diaphragm and voice coil support with the deep-draw method.

It is therefore the task of the invention to present a loudspeaker wherein the different loudspeaker components, particularly voice coil support and loudspeaker diaphragm, are joined to each other in an environmentally friendly manner operable at temperatures above 120 degrees Celsius.

SUMMARY OF THE INVENTION

According to the present invention, if the loudspeaker components to be joined are provided with an ultrasonically weldable metal at least on the facing surfaces intended to be joined, the respective loudspeaker components can very easily be joined to each other by ultrasonic welding technology, insofar as the thickness of the respective metal coating measures no more than 8 μm. The joint is particularly easy to achieve if the components to be joined are made entirely of ultrasonically weldable metal, since the coating of the surface areas to be joined could be omitted in that case.

The welding technology joint can be equally well achieved between the voice coil support and the loudspeaker diaphragm, between the voice coil support and the centering diaphragm, and between the loudspeaker diaphragm and the centering diaphragm. However, this does not mean that such joints between loudspeaker components can only be achieved by ultrasonic welding technology, when they require a low joint weight. Rather, the joint between the centering diaphragm and the loudspeaker frame can also be ultrasonically welded.

It is especially advantageous if the voice coil support is connected to the loudspeaker diaphragm, or the centering diaphragm to the voice coil support or the loudspeaker diaphragm, by interposing an insulation arrangement, whose insulator is coated with an ultrasonically weldable material on two facing surfaces. If the insulation arrangement is located between the voice coil support and the loudspeaker diaphragm, the heat transfer from loudspeaker diaphragm to voice coil support is made more difficult in loudspeaker diaphragms that are subject to high thermal loads, so that special measures for insulating the voice coil wire on the voice coil support are no longer required. If the insulation arrangement on one side is attached to the loudspeaker diaphragm or the voice coil support, and on the other side to a metal centering diaphragm, the latter can be used as a contact bridge between the ends of the voice coil wire and the ends of the audio signal line for example, if it is made of two or more parts that are not connected to each other.

Ceramic or polyimide materials are suitable insulation materials. Such materials can be coated in suitable material thicknesses with aluminum or copper, for example.

Particularly good ultrasonic weldability of the centering diaphragm is provided, if the centering diaphragm metal coating is placed at least on one surface area of the centering diaphragm, and penetrates into the weave openings in the centering diaphragm.

The use of non-metallic centering diaphragms and/or centering diaphragms without any netting structure, which are therefore unbroken, can be joined to the former loudspeaker components if the joining edge encases the rim of the centering diaphragms.

BEST MODE FOR CARRYING OUT THE INVENTION

Figure 1:
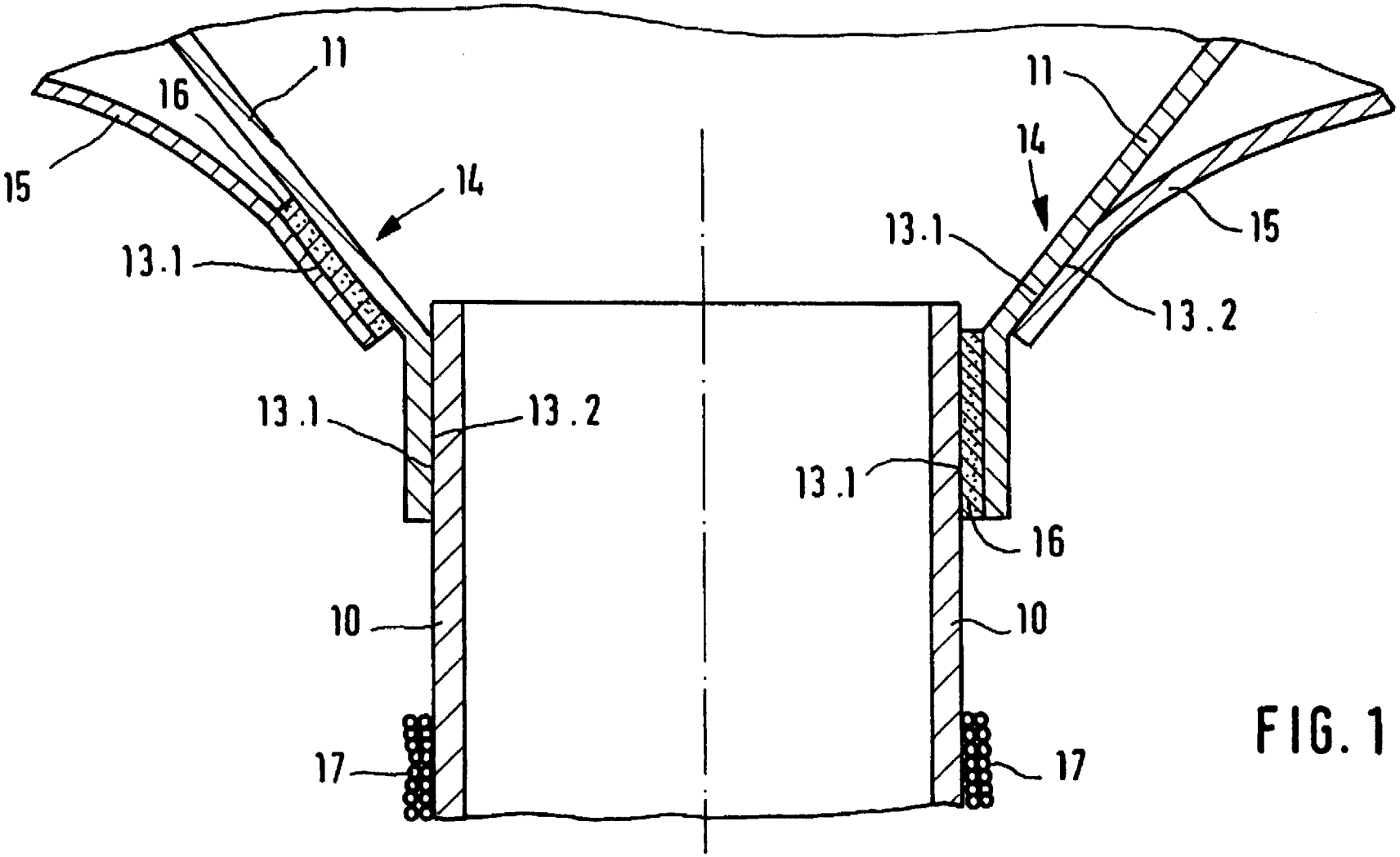
FIG. 1 is a cross-section of a voice coil support.

FIG. 1 depicts a cut through a section of a loudspeaker, in which the sides of the illustrations are the subjects of different configuration examples.

The illustration in FIG. 1 depicts a voice coil support 10 joined at its upper edge to the loudspeaker diaphragm 11. The loudspeaker diaphragm 11 and the voice coil support 10 are made of aluminum, so that the surface areas 13.1, 13.2 of loudspeaker diaphragm 11 and voice coil support 10, which contact each other, consist of materials that can be ultrasonically welded. The joint between the loudspeaker diaphragm 11, which is the first loudspeaker component in the sense of claims 1 to 3 in the joint area being addressed here, is ultrasonically welded to the voice coil support 10, which is another component in the sense of claims 1 and 2.

Figure 2:
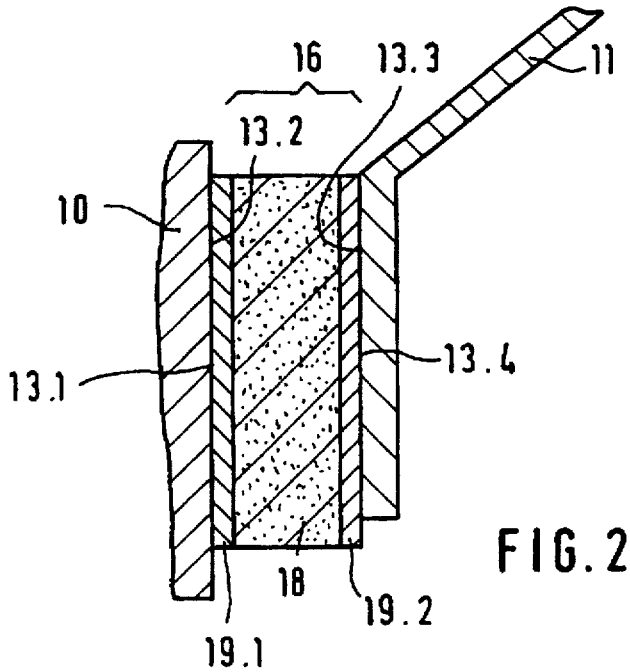
FIG. 2 is a further depiction of FIGS. 1A and 1B.

Furthermore, the cone area 14 of the loudspeaker diaphragm 11 is joined to the centering diaphragm 15, where an insulation arrangement 16 is placed between the loudspeaker diaphragm 11 and the centering diaphragm 15, which is explained in more detail in FIG. 2.

It should already be pointed out in this connection that, when the centering diaphragm 15 is joined to the loudspeaker diaphragm 11, a two-part configuration of a centering diaphragm made of metal can be used as a contact bridge between the wire ends of the voice coil 17 located on the voice coil support 10, and the wire ends of the audio signal line (none of which is illustrated in FIG. 1). In that case, the usual stranded contact of voice coil 17 with the audio signal line can be omitted.

FIG. 2 depicts an enlarged scale insulation arrangement 16. This insulation arrangement 16 consists of a placement of the insulator 18, which in this configuration example is made of ceramic material. The insulation arrangement 16, which is another loudspeaker component in the sense of claim 1 or claim 3, has a metal coating 19.1 that is made of copper in the present example, on the side of the insulator 18 facing the first loudspeaker component, in this case the voice coil support 10. Ultrasonic welding is used to join the surface area 13.2 of the metal coating 19.1 to the surface area 13.1 of the aluminum voice coil support 10.

Another metal coating 19.2, also made of copper, is located on the side of the insulator 18 facing away from the metal coating 19.1, and is not conductively joined to the metal coating 19.1.

The surface area 13.3 of the metal coating 19.2 is also ultrasonically welded to the surface area 13.4 of the aluminum loudspeaker diaphragm 11.

Each of the two metal coatings 19.1 and 19.2 has a thickness of at least 8 μm, while the thickness of the insulation layer 18 is approximately 1 mm.

The configurability of the invention is not limited to the use of copper as the metal of metal coatings 19.1, 19.2. Rather, the respective metal coating can be aluminum or nickel. Good results were obtained with a polyimide foil as the insulator 18, which was coated on both sides with aluminum to form an insulation arrangement 16.

The insulation arrangement 16 shown in FIG. 2 essentially depicts the mounting situation according to the illustration in FIG. 1. If the centering diaphragm 15 does not have to be conductively joined to loudspeaker diaphragm 11, the insulation arrangement 16 of FIG. 2 can also be used in this configuration example. In this case, the loudspeaker diaphragm 11 is the first loudspeaker component in the sense of claims 1 to 3, while the insulation arrangement 16 is the other component in the sense of claims 1 and 3.

Figure 3:
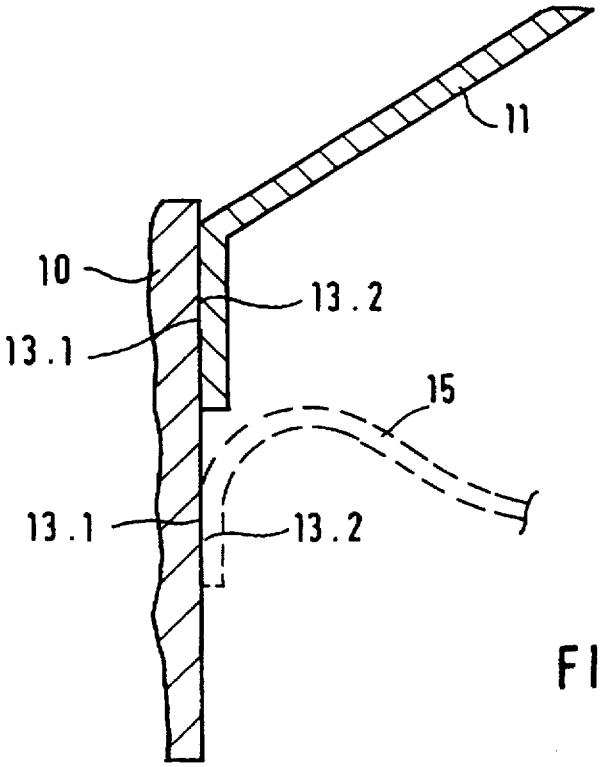
FIG. 3 is a further depiction of FIGS. 1A and 1B.

FIG. 3 is another illustration of a loudspeaker cross-section. The first component of the loudspeaker in the sense of claims 1 and 2 consists of the voice coil support 10, while the loudspeaker diaphragm 11 is the other loudspeaker component in the sense of claims 1 and 2.

The two cited components 10, 11 are made of aluminum and are ultrasonically welded to each other.

An insulation arrangement 16 according to FIG. 2 can also be interposed (not shown in FIG. 3), insofar as heat insulation between the two components 10, 11 is required.

Deviating from the illustrations according to FIG. 1, the arrangement shown in FIG. 3 has a centering diaphragm 15, which is joined to the voice coil support 10. If necessary in this case as well, an insulation arrangement 16 according to FIG. 2 can be interposed between the centering diaphragm 15 and the voice coil support (not illustrated in FIG. 3). The broken line illustration of centering diaphragm 15 in FIG. 3 makes it clear that the centering diaphragm 15 can be entirely omitted, if the centering of the voice coil support 10 is also accomplished in a different way—perhaps as shown in DE 4241212. Further details of joining a centering diaphragm 15 shown in FIG. 3 to the voice coil support 10 or the loudspeaker diaphragm 11 will be explained in more detail in conjunction with FIGS. 5*a–d*.

Figure 4:
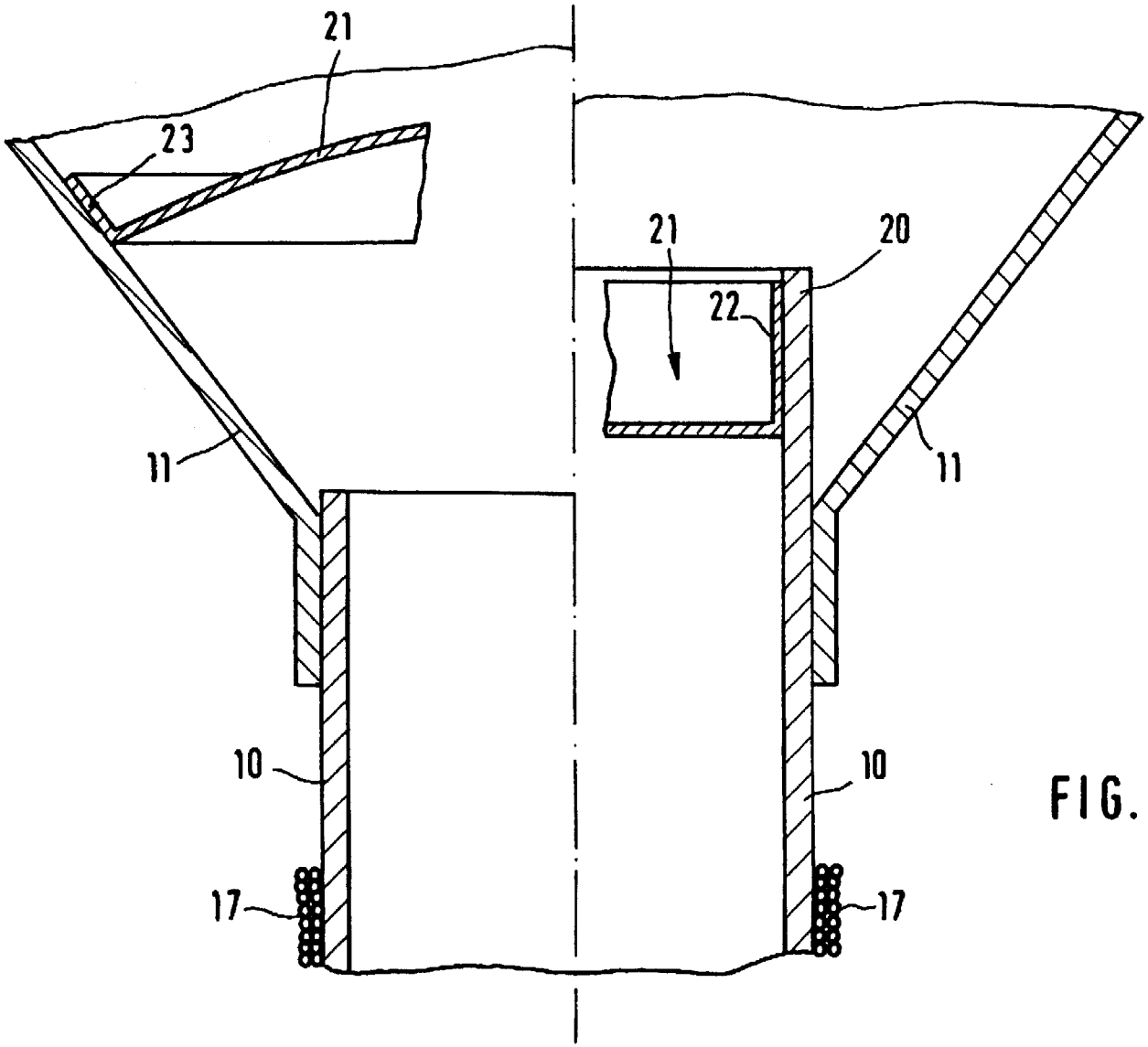
FIG. 4 is a further depiction of FIG. 1.

FIG. 4 depicts joint of voice coil support 10 and loudspeaker diaphragm 11 according to the invention.

The voice coil support 10 and the loudspeaker diaphragm 11 are made of aluminum in both configuration examples, and are joined by ultrasonic welding without the interposition of an insulation arrangement 16.

In contrast to the illustration in FIG. 1 the illustration of FIG. 4 depicts the voice coil support 10 as being longer, therefore protruding with its upper end 20 deeper into the cone formed by loudspeaker diaphragm 11. The upper end 20 of the voice coil support 10 is joined to a pot-shaped cap 21 that is also made of aluminum, which closes off the inside cross-section of the voice coil support 10. To make the ultrasonic weldability of the joint of cap 21 to voice coil support 10 possible, it is essential that the rim 22 of the cap 21, whereby it is joined to the inner jacket of voice coil support 10, points in the direction that faces away from voice coil 17. The latter because, after the cap 21 is mounted with the rim 22 pointing downward, the space for welding electrodes, which is limited by the cap 21 and voice coil support 10, is no longer accessible.

The illustration in FIG. 4 shows a dust protection cap 21, which is also made of aluminum and has a concave shape. The surrounding flange 23 of this dust protection cap 21 is ultrasonically welded to the inside of loudspeaker diaphragm 11.

If a centering diaphragm 15 according to FIG. 3 exists and is joined to the voice coil support 10 or the loudspeaker diaphragm 11, the state of the art usually achieves such a joint by adhesive bonding. In view of the problems connected with such adhesive bonds at high ambient temperatures, a joint between the centering diaphragm 15 and the voice coil support 10 or the loudspeaker diaphragm 11, which solves the temperature problems, will now be presented in conjunction with FIG. 5. If the respective surface areas 13 of the two last-named components 10, 11 are partially or entirely made of an ultrasonically weldable metal, the centering diaphragm 15 can very easily be joined to these components 10, 11 by ultrasonic welding, if at least the surface areas 13 of the centering diaphragm 15, which are joined to the respective component 10, 11, are also made of an ultrasonically weldable metal. Since centering diaphragms 15 are normally made of a textile or plastic fabric, the producibility of an ultrasonically weldable coating on such materials is very time consuming and can only be realized at great cost. By contrast, if a metal fabric is used as the centering diaphragm 15 material, it can very easily be coated by a galvanic process with a different metal, which is ultrasonically weldable to the centering diaphragm 15 metal, for example. Although such a galvanic coating can be manufactured on the centering diaphragm 15 with a good bond, such coating methods are not without question for reasons of protection of the environment. It is therefore considerably more advantageous to achieve the joint between the centering diaphragm 15 and the ultrasonically weldable metal coating as described in more detail in the following.

Figure 5A:
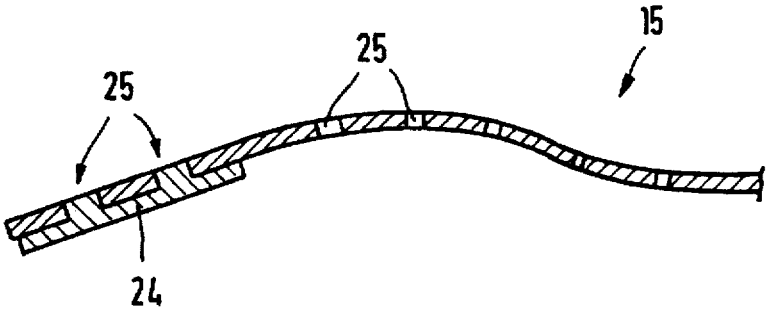
FIG. 5 is a further depiction of FIG. 3.

Since conventionally configured centering diaphragms 15 have a wavy contour, it is usual to form this contour by embossing. If a thin, ultrasonically weldable metal strip is simultaneously placed into the embossing machine, the metal of the strip flows or penetrates into the centering diaphragm 15 under the embossing machine's pressure. After completion of this process, a condition is obtained, which is schematically illustrated in FIG. 5*a*. It can clearly be seen in this illustration that after the centering diaphragm 15 has been embossed, the area of the strip 24 that faces the centering diaphragm 15 penetrates into the weave openings 25 in the centering diaphragm 15. Once areas of the strip 24 penetrate into the weave openings 25 in the centering diaphragm 15, a joint is produced between the two parts 15, 24, which permits recognizing both parts as one unit. If a unit consisting of both parts 15, 24 must be ultrasonically welded to the voice coil support 10 or the loudspeaker diaphragm 11, it is essential that the side of the centering diaphragm 15 that faces away from the strip 24 is placed against the voice coil support 10 or the loudspeaker diaphragm 11. This is so, because the areas of the strip 24 that penetrate into the weave openings 25 are not yet capable by themselves to join the centering diaphragm 15 permanently, for example to the voice coil support 10 under a mechanical load. The desirable high mechanical strength between centering diaphragm 15 and voice coil support 10 or loudspeaker diaphragm 11 is only achieved when the centering diaphragm 15 is located between the strip 24 and the voice coil support 10, and the areas of the strip 24 penetrating into the weave openings 25 are ultrasonically welded to the voice coil support 10 or the loudspeaker diaphragm 11. The latter is schematically illustrated in FIG. 5*b* for a joint between a loudspeaker diaphragm 11 and a centering diaphragm 15.

A particularly stable attachment between the centering diaphragm 15 and the respective loudspeaker component 10, 11 can be achieved if the strip 24, which is placed into the press during the embossing of the centering diaphragm 15, is softened by ultrasound. This softening can also take place after the centering diaphragm 15 is joined to the strip 24 subsequent to the embossing process. With the corresponding configuration of the embossing machine or the ultrasonic welding device, in both cases the metal of strip 24 penetrates into the weave openings 25 in such a way, that a generally thin metal film 26 also forms on the side of the centering diaphragm 15 that faces away from the strip 24. The latter is schematically illustrated in FIG. 5*c*. Since the metal film 26 and the remaining strip 24 have approximately the same thickness, it makes no difference in the welding of the loudspeaker diaphragm 11 or the voice coil support 10, whether the metal film 26 or the strip 24 is used for that purpose.

Figure 5B:
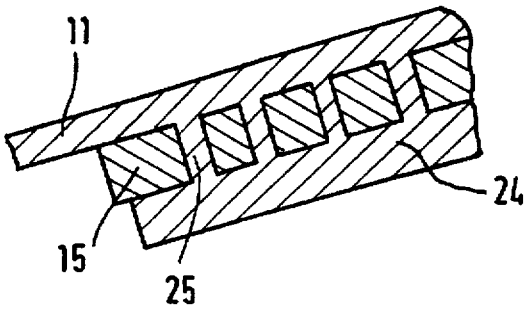
Figure 5C:
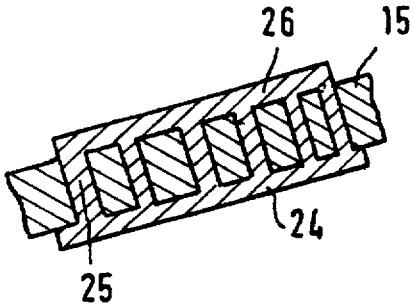
Figure 5D:
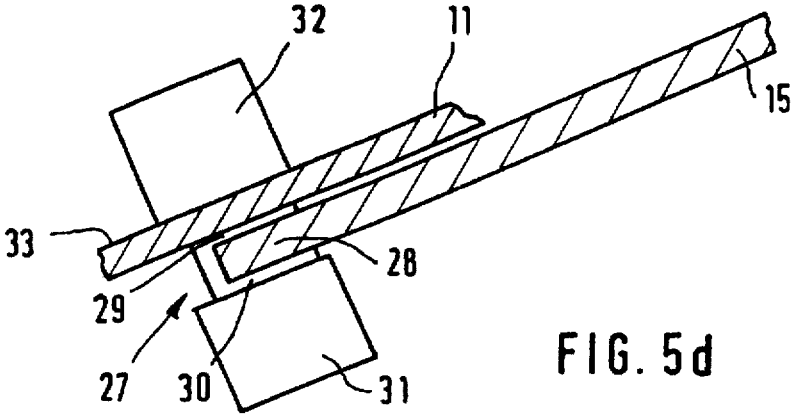

The centering diaphragm 15 mentioned in connection with FIGS. 5*a* to 5*c* was made of a steel wire fabric. The wire thickness was about 0.1 mm. This does not mean that the centering diaphragm 15 cannot also be made of a non-metal. However, when non-metals are used, the process should be modified so that no strip is used to be pressed through the weave openings. Instead, with centering diaphragms 15 made of a non-metal, the rim of the centering diaphragm 15 to be joined to the loudspeaker diaphragm 11 or the voice coil support 10 is enclosed in an approximately U-shaped profile of ultrasonically weldable metal. The latter is shown in FIG. 5*d*. The enclosure 27 shown in this FIG. 5*d* was formed by bending an L-shaped elbow around the rim 28 of the centering diaphragm 15, so that after the bending, both legs 29, 30 of the U-shaped profile are clamped around the rim 28. A stable joint of enclosure 27 and centering diaphragm 15 is produced, if the surfaces of the enclosure 27, which are located against the centering diaphragm 15, are roughened or provided with projections (not illustrated), which penetrate into the centering diaphragm 15 after the bending. For additional strength, the enclosure 27 and the centering diaphragm 15 can also be provided with an approximately step-shaped embossed bead (not illustrated).

For the purpose of completion, it should be pointed out in this connection that when the enclosure 27 is used, the centering diaphragm 15 does not necessarily have to be made of an open fabric. Nor is the enclosure 27 limited to non-metallic centering diaphragms 15, but can also be used with centering diaphragms 15 that are made of metal.

The joint between the centering diaphragm 15 equipped with enclosure 27, and the loudspeaker diaphragm 11 for example, is accomplished in that the leg 30 of enclosure 27 is placed on an anvil 31 used as a counter-electrode. For welding, the "sonotrode" 32 is placed on the inside 33 of the loudspeaker diaphragm 11 in such a way, that the loudspeaker diaphragm 11 and the legs 29, 30 of the enclosure 27 and the rim 28 are pressed against the anvil 31. If ultrasonic welding is performed in that condition, the leg 29 of enclosure 27 is joined to the loudspeaker diaphragm 11. If the centering diaphragm 15 is made of an open fabric, the metal of enclosure 27 penetrates into the weave openings 25 (not shown in FIG. 5*d*) and therefore joins both legs 29, 20 through the centering diaphragm 15.

Although the configuration examples explained in conjunction with FIGS. 5*a* to 5*d* only concern the joint between centering diaphragm 15 and loudspeaker diaphragm 11 or voice coil support 10, the indicated measures can also be used to join the centering diaphragm 15 to the loudspeaker frame (not illustrated).

What is claimed is:

1. A loudspeaker having a loudspeaker diaphragm (10) and a voice coil support (11), characterized in that at least one surface area (13.1) of a first loudspeaker component, and at least one surface area (13.2) of a second loudspeaker component, are made of ultrasonically weldable metals, the first and second components are ultrasonically welded to each other at their respective surface areas (13.1, 13.2), the first loudspeaker component is the voice coil support (10) or the loudspeaker diaphragm (11), the second loudspeaker component is an insulation arrangement (16) having an insulator layer (18) with an ultrasonically weldable metal coating (19.2), the ultrasonically weldable metal coating (19.2) of the insulator (18) is joined by ultrasonic welding to a surface area (13.4) of a part of the loudspeaker that is different from the first loudspeaker component, and the insulator 18 is made of ceramic material.

2. A loudspeaker having a loudspeaker diaphragm (10) and a voice coil support (11), characterized in that at least one surface area (13.1) of a first loudspeaker component, and at least one surface area (13.2) of a second loudspeaker component are made of ultrasonically weldable metals, the first and second components are ultrasonically welded to each other at their respective surface areas (13.1, 13.2), the first loudspeaker component is the voice coil support (10) or the loudspeaker diaphragm (11), the second loudspeaker component is an insulation arrangement (16), having an insulator layer (18) with an ultrasonically weldable metal coating (19.2), the ultrasonically weldable metal coating (19.2) of the respective insulator (18) is joined by ultrasonic welding to a surface area (13.4) of a part of the loudspeaker that is different from the first loudspeaker component, and the insulator 18 is made of polyimide.

3. A loudspeaker having a loudspeaker diaphragm (10) and a voice coil support (11), characterized in that at least one surface area (13.1) of a first loudspeaker component, and at least one surface area (13.2) of a second loudspeaker component are made of ultrasonically weldable metals, the first and second components are ultrasonically welded to each other at their respective surface areas (13.1, 13.2), either the first loudspeaker component is a voice coil support (10) and the second loudspeaker component is either a loudspeaker diaphragm (11) or a centering diaphragm (15), or alternatively, the first loudspeaker component is a loudspeaker diaphragm (11) and the second loudspeaker component is either a voice coil support (10) or a centering diaphragm (15), an area of the centering diaphragm (15) provided as the joint to the loudspeaker diaphragm (11) has an ultrasonically weldable metal coating, which is placed at least on one surface area of the centering diaphragm (15), and penetrates into weave openings (25) in the centering diaphragm (15).

4. A loudspeaker having a loudspeaker diaphragm (10) and a voice coil support (11), characterized in that at least one surface area (13.1) of a first loudspeaker component and at least one surface area (13.2) of a second loudspeaker component are made of ultrasonically weldable metals, the first loudspeaker component and the second loudspeaker component are ultrasonically welded to each other at respective surface areas (13.1, 13.2), the first loudspeaker component is the loudspeaker diaphragm (11), the second loudspeaker component is either a voice coil support (10) or a centering diaphragm (15), an enclosure (27) made of ultrasonically weldable material having a rim (28) for encasing the centering diaphragm (15) and for providing an ultrasonic joint between the loudspeaker diaphragm (11) and the centering diaphragm (15).

5. A loudspeaker, comprising:

a loudspeaker diaphragm having a metallic cylindrical contacting surface;

a second loudspeaker component having a corresponding metallic cylindrical contacting surface; and an ultrasonic welding Joint for connecting the metallic cylindrical contacting surface of the loudspeaker diaphragm and the corresponding metallic cylindrical contacting surface of the second loudspeaker component wherein the loudspeaker further comprises an insulator having opposing metallic cylindrical contacting surfaces for ultrasonically welding the metallic cylindrical contacting surface of the loudspeaker diaphragm and the corresponding metallic cylindrical contacting surface of the second loudspeaker component.

6. A loudspeaker according to claim 5, wherein the second loudspeaker component is a voice coil support.

7. A loudspeaker according to claim 5, wherein the second loudspeaker component is a centering diaphragm.

8. A loudspeaker comprising:

a diaphragm being made of weldable metal and having a Surface area for ultrasonic welding; and another loudspeaker component being made of weldable metal and having a corresponding surface area for ultrasonic welding;

an ultrasonic welding joint means for connecting the surface area of the diaphragm and the corresponding surface area of the other loudspeaker component;

wherein the diaphragm is a loudspeaker diaphragm for providing sound from the loudspeaker;

wherein the other loudspeaker component is a voice coil support; and wherein the loudspeaker further comprises an insulation arrangement disposed between the loudspeaker diaphragm and the voice coil support.

9. A loudspeaker according to claim 8, wherein the insulation arrangement includes an insulator having a first metal coating and a second metal coating.

10. A loudspeaker according to claim 9, wherein the ultrasonic welding joint means includes a first ultrasonic joint for connecting the surface area of the loudspeaker diaphragm and the first metal coating of the insulation arrangement; and wherein the ultrasonic welding joint means includes a second ultrasonic joint for connecting the corresponding surface area of the voice coil support and the second metal coating of the insulation arrangement.

11. A loudspeaker according to claim 8, wherein the loudspeaker diaphragm and the voice coil support are both made entirely of an ultrasonically weldable metal.

12. A loudspeaker comprising:

a diaphragm being made of weldable metal and having a surface area for ultrasonic welding; and another loudspeaker component being made of weldable metal and having a corresponding surface area for ultrasonic welding;

an ultrasonic welding joint means for connecting the surface area of the diaphragm and the corresponding surface area of the other loudspeaker component;

wherein the diaphragm is a loudspeaker diaphragm for providing sound from the loudspeaker;

wherein the other loudspeaker component is a centering diaphragm for providing centering to the loudspeaker diaphragm; and wherein the loudspeaker further comprises an insulation arrangement disposed between the loudspeaker diaphragm and the centering diaphragm.

13. A loudspeaker according to claim 12, wherein the insulation arrangement includes an insulator having a first metal coating and a second metal coating.

14. A loudspeaker according to claim 13, wherein the ultrasonic welding joint means includes a first ultrasonic Joint for connecting the surface area of the loudspeaker diaphragm and the first metal coating of the insulation arrangement; and wherein the ultrasonic welding joint means includes a second ultrasonic joint for connecting the corresponding surface area of the centering diaphragm and the second metal coating of the insulation arrangement.

15. A loudspeaker according to claim 12 wherein the loudspeaker diaphragm and the loudspeaker centering diaphragm are both made entirely of an ultrasonically weldable metal.

16. A loudspeaker comprising:

a diaphragm being made of weldable metal and having a surface area for ultrasonic welding; and another loudspeaker component being made of weldable metal and having a corresponding surface area for ultrasonic welding;

an ultrasonic welding joint means for connecting the surface area of the diaphragm and the corresponding surface area of the other loudspeaker component;

wherein the diaphragm is a centering diaphragm for providing centering to a loudspeaker diaphragm;

wherein the other loudspeaker component is a voice coil support; and wherein the loudspeaker further comprises an insulation arrangement disposed between the centering diaphragm and the voice coil support.

17. A loudspeaker according to claim 16, wherein the insulation arrangement includes an insulator having a first metal coating and a second metal coating.

18. A loudspeaker according to claim 17, wherein the ultrasonic welding joint means includes a first ultrasonic joint for connecting the surface area of the centering diaphragm and the first metal coating of the insulation arrangement; and wherein the ultrasonic welding joint means includes a second ultrasonic joint for connecting the corresponding surface area of the voice coil support and the second metal coating of the insulation arrangement.

19. A loudspeaker according to claim 16, wherein the loudspeaker centering diaphragm and the voice coil support are both made entirely of an ultrasonically weldable metal.

* * * * *